US005351732A

United States Patent [19]

Mills et al.

[11] Patent Number: 5,351,732

[45] Date of Patent: Oct. 4, 1994

[54] GAS TURBINE ENGINE CLEARANCE CONTROL

[75] Inventors: Stephen J. Mills, Derbyshire; Robin D. Monico, Derby; Andrew J. Bradley, Derbyshire, all of England

[73] Assignee: Rolls-Royce plc, London, England

[21] Appl. No.: 78,218

[22] PCT Filed: Nov. 8, 1991

[86] PCT No.: PCT/GB91/01964

§ 371 Date: Jun. 22, 1993

§ 102(e) Date: Jun. 22, 1993

[87] PCT Pub. No.: WO92/11444

PCT Pub. Date: Jul. 9, 1992

[51] Int. Cl.[5] ..... F01D 5/08

[52] U.S. Cl. ..... 415/175; 415/115; 415/177

[58] Field of Search ..... 415/115, 116, 175, 177

[56] References Cited

U.S. PATENT DOCUMENTS

| | | | |
|---|---|---|---|
| 3,975,901 | 8/1976 | Hallinger et al. | 415/115 |
| 4,296,599 | 10/1981 | Adamson | 415/115 |
| 4,645,416 | 2/1987 | Weiner | 415/115 |
| 4,648,241 | 3/1987 | Putman et al. | 415/115 |
| 5,064,343 | 11/1991 | Mills | 415/115 |
| 5,127,793 | 7/1992 | Walker et al. | 415/115 |

*Primary Examiner*—John T. Kwon

*Attorney, Agent, or Firm*—Cushman, Darby & Cushman

[57] ABSTRACT

A gas turbine engine includes a casing cooling system which operates in one of two conditions, the first being operational at engine cruise, where all of the cooling air is initially directed onto a specific region of the casing; under full power conditions, some of the cooling air is directed onto the specific casing region and the reminder directed onto the reminder of the casing; the cooling system operates to optimize turbine blade/casing radial clearances.

8 Claims, 3 Drawing Sheets

GAS TURBINE ENGINE CLEARANCE CONTROL

FIELD OF THE INVENTION

This invention relates to the control of the clearance between the turbine rotor blades of a gas turbine engine and the static structure which surrounds the radially outer extents of those blades.

BACKGROUND OF THE INVENTION

The turbine of an axial flow gas turbine engine conventionally comprises at least one annular array of radially extending rotor aerofoil blades located in the primary motive fluid passage of the engine. The radially outer extents of the blades are surrounded in radially spaced apart relationship by an annular sealing member attached to the casing of the turbine. The radial distance between the blades and the sealing member is desirably as small as possible in order to minimise the leakage of motive fluid gases past the rotor blades: the greater the leakage of gases, the lower the efficiency of the turbine.

Unfortunately during a typical gas turbine engine operating cycle, rotational speed and temperature variations within the turbine result in significant variation of the radial clearance between the blades and the sealing member. Accordingly in order to ensure that damaging contact does not occur between the blades and sealing member, the clearance between them has to be larger than would otherwise be desirable for certain engine operating conditions.

The condition which results in the smallest clearance between the blades and sealing member occurs when the gas turbine engine is suddenly brought up to full power. Typically this occurs during the take-off of an aircraft powered by the engine. Under these conditions the blades heat up rapidly and so thermally expand. Additionally their rotational speed increases so that they are subjected to centrifugal growth. At the same time the sealing member and the casing which supports it heat up rapidly and so thermally expand.

The rate of thermal expansion of the casing and the blades and associated structure are desirably matched so that the rotor blade/sealing member radial gap remains within acceptable limits. This is achieved by the so-called "slugging" of the turbine casing. "Slugging" is the positioning of slugging masses or thermal barriers on the casing to modify its thermal expansion behaviour.

When the gas turbine engine assumes a steady state, typically under cruise conditions, a temperature equilibrium situation is reached. However, the equilibrium temperature reached by the various components of the turbine are such that the radial gap between the turbine blades and their associated sealing member is larger than would otherwise be desirable.

Attempts have been made to overcome the problem of variation in the radial gap between the sealing member and the blades by the provision of intermittent cooling of the turbine casing. Typically the casing is uncooled during take-off to ensure that the radial gap remains within acceptable limits. However when cruise conditions are reached, casing cooling is commenced to reduce the radial clearance between the sealing member and the turbine blades to an optimum value.

One drawback with this arrangement is that since the turbine casing is modified by slugging to slow down its thermal response rate, it is equally slow to respond to the effects of deliberate cooling.

A further drawback is that the turbine casing must be made from an alloy which is sufficiently resistant to the high temperatures which it is likely to reach when it is not cooled.

SUMMARY OF THE INVENTION

It is an object of the present invention to provide a gas turbine engine turbine in which such drawbacks are substantially avoided.

According to the present invention, a gas turbine engine turbine comprises a casing enclosing a plurality of annular arrays of rotor aerofoil blades, said blades being arranged in radially spaced apart relationship with said casing, means being provided to direct cooling air on to the outer surface of said casing to provide cooling thereof, control means being provided to control the distribution of said cooling air so directed on to said casing between two circumferential, axially adjacent regions of said casing, means being provided to facilitate a flow of cooling air from the forward of said regions to the rearward region, said control means being adapted to vary the distribution of said cooling air flow between a first condition in which all of said cooling air is initially directed on to the forward of said casing regions, and a second condition in which some of said cooling air is initially directed on to the forward of said casing regions and remainder is directed only on to the rearward of said casing regions.

The invention will now be described, by way of example, with reference to the accompanying drawings in which:

DETAILED DESCRIPTION OF THE INVENTION

Figure 1:
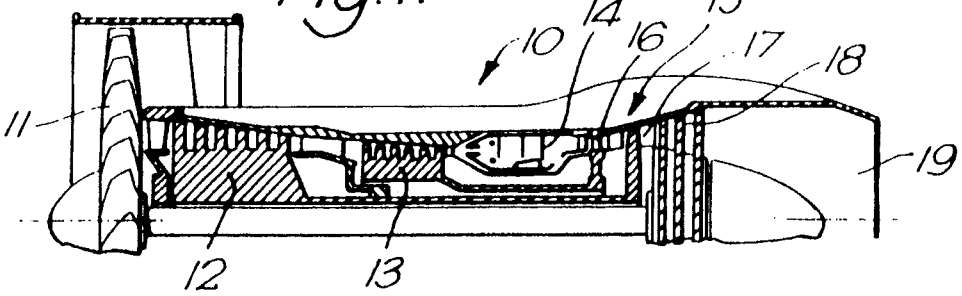
FIG. 1 is a sectioned side view of the upper half of a ducted fan gas turbine engine which incorporates a turbine in accordance with the present invention.

Referring to FIG. 1, a ducted fan gas turbine engine generally indicated at 10 comprises, in axial flow series, a fan 11, an intermediate pressure compressor 12, high pressure compressor 13, combustion equipment 14, a turbine 15 having high, intermediate and low pressure turbine sections 16,17 and 18 respectively and an exhaust nozzle 18.

Air entering the engine 10 is accelerated by the fan 11. Part of the air flow exhausted- from the fan 11 provides propulsive thrust while the remainder is directed into the intermediate pressure compressor 12. After compression by the intermediate pressure compressor 12, the air is compressed still further by the high pressure compressor 13 before being directed into the combustion equipment 14. There the air is mixed with fuel and combusted. The resultant hot combustion products then expand through the high, intermediate and low pressure turbine sections 16,17 and 18, which respectively drive the high pressure compressor 13, intermediate pressure compressor 12 and fan 11, before being exhausted through the propulsion nozzle 18.

Figure 2:
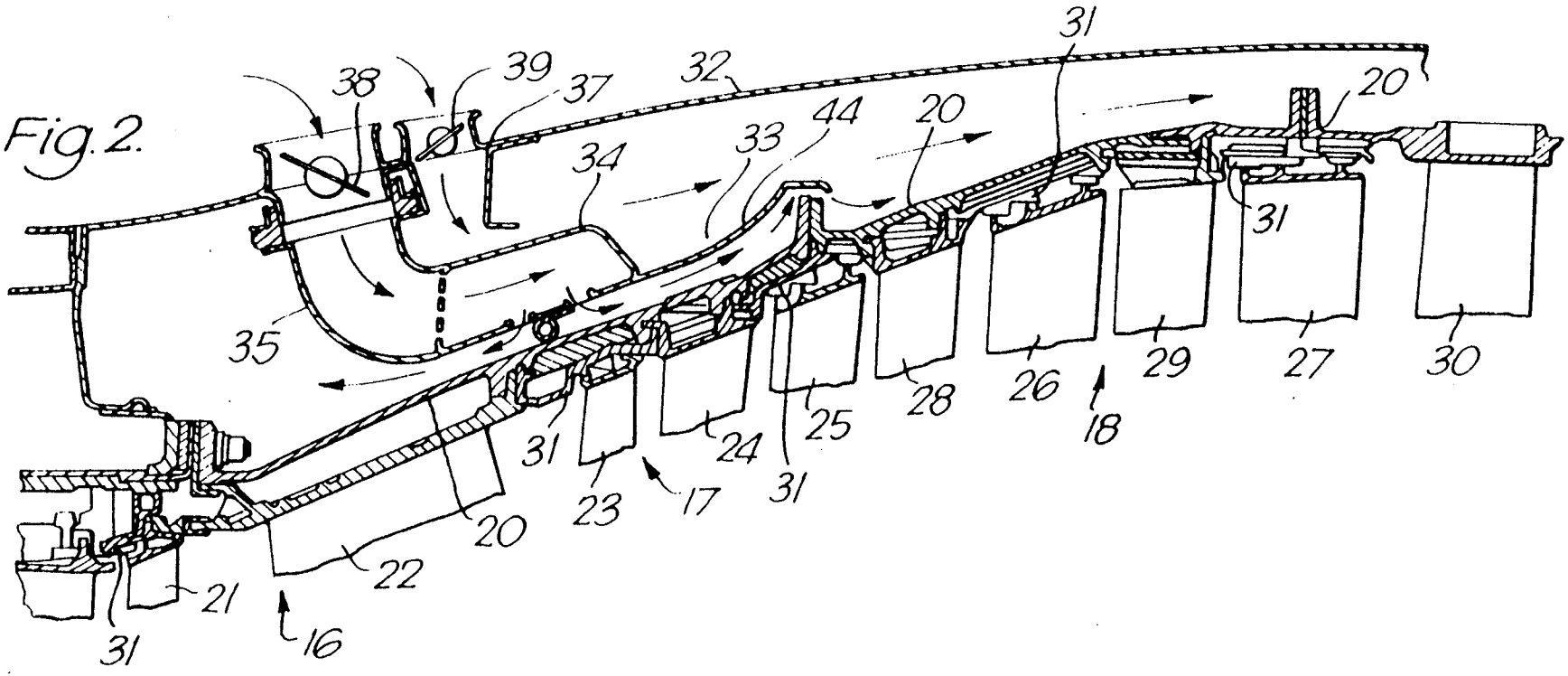
FIG. 2 is a sectioned view of a portion of the turbine of the engine shown in FIG. 1.

The high, intermediate and low pressure turbines sections 16,17 and 18 respectively can be seen in more detail if reference is now made to FIG. 2.

The high pressure section 16 comprises an annular array of rotor aerofoil blades 21 and an annular array of stator aerofoil vanes 22. Similarly the intermediate pressure section 17 comprises an annular array of rotor aerofoil blades 23 and an annular array of stator aerofoil vanes 24. The low pressure compressor 18, however, is provided with three annular arrays of rotor aerofoil blades 25,26 and 27 respectively and three annular arrays of stator aerofoil vanes 28,29 and 30 respectively. All of the stator vane arrays 22,24,28,29 and 30 are fixedly attached to the radially inner surface of the casing 20.

The casing 20 also carries sealing members 31 which are located radially outwardly of the annular arrays of rotor blades 21,23,25,26 and 27. The sealing members 31 are each annular so as to surround their corresponding rotor blade array and are additionally segmented so that they move radially inward and outward with the thermal expansion and contraction of the turbine casing 20. The radial gap between the radially outer extents of the rotor blades 21,23,25,26 and 27 of each annular array and its corresponding sealing member 31 is arranged to be as small as possible in order to ensure that gas leakage through the gaps is minimised. The manner in which the gaps are so minimised forms the basis of the present invention.

Figure 3:
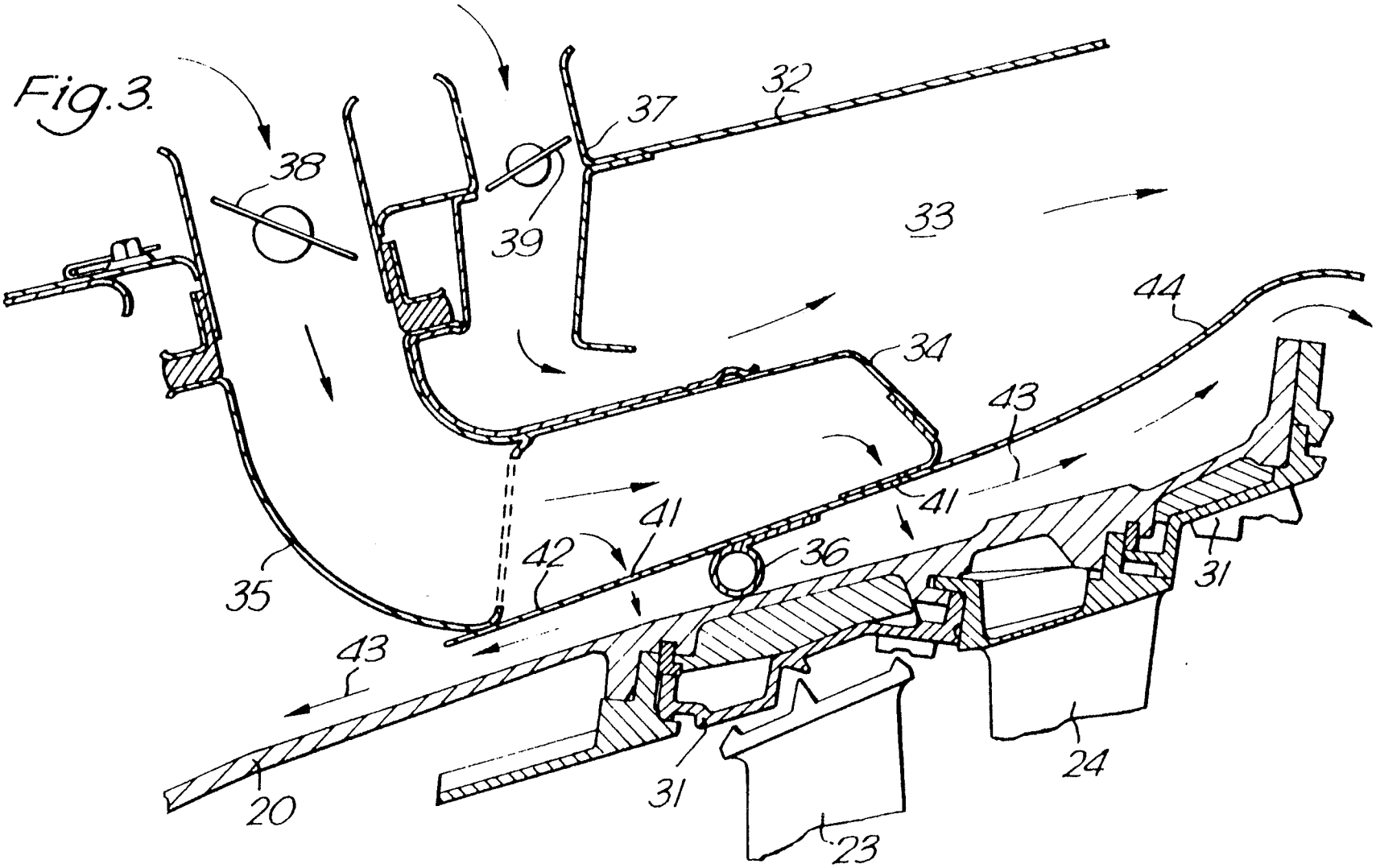
FIG. 3 is a view on an enlarged scale of part of the view shown in FIG. 2.

The casing 20 is surrounded in spaced apart relationship by a cowling 32 so that an annular space 33 is defined between them. The space 33 contains an annular manifold 34, the structure of which can be more easily seen if reference is now made to FIG. 3.

The manifold 34 is located radially outwardly of the portion of the casing 20 which surrounds the rotor blades 23 of the intermediate pressure turbine section 17. The manifold 34 is supported by a number of cooling air feed pipes 35 which are equally spaced around the turbine 15 and are themselves supported by the cowling 32. An annular sealing member 36 is located approximately half way along the axial extent of the manifold 34 to radially space apart the manifold 34 and the turbine casing 20.

A number of apertures 37 are provided in the cowling 32 immediately downstream of the cooling air feed pipes 35. Each of the cooling air feed pipes 35 and the apertures 37 is fed with a supply of pressurised cooling air tapped from the exhaust outlet of the engine fan 11. The cooling air flow into each of the cooling air feed pipes 35 is modulated by a flap valve 38 located in the cooling air feed pipe 35 entrance. Similarly the cooling air flow through each of the apertures 37 is modulated by a flap valve 39 located in the aperture 37. The manner in which the flap valves 38 and 39 are controlled will be described later.

The cooling air which flows into the cooling air feed pipes 35 is directed into the manifold 34. A number of apertures 41 are provided in the radially inner wall 42 of the manifold 34 to permit the escape of cooling air from the manifold 34. The cooling air escapes through the apertures 41 to impinge upon, and thereby provide impingement cooling of, the portion of the turbine casing 20 immediately radially outwardly of the rotor blades 23 of the intermediate pressure compressor.

The impingement cooling apertures 41 in the manifold 34 are located both upstream and downstream of the annular sealing member 36. Consequently cooling air, exhausted from the manifold 34 after it has provided impingement cooling of the casing 20, flows in both upstream and downstream directions as shown by the arrows 43 to provide convection cooling of the turbine casing 20.

An annular shield 44 is attached to the downstream end of the manifold 44 to ensure that cooling air which has been exhausted from the impingement cooling apertures 41 downstream of the sealing member 36, is constrained to flow over the turbine casing 20. The shield 44 terminates radially outwardly of the first stage of rotor blades 25 of the low pressure turbine 18.

It will be seen therefore that cooling air exhausted from the manifold 34 provides impingement cooling of the portion of the turbine casing 20 radially outwardly of the rotor blades 23 as well as convection cooling of other portions of the turbine casing 20.

Cooling air flowing through the cowling apertures 37 is directed generally into the annular space 33, thereby provided general convection cooling of the portions of the casing 20 which surround the low pressure turbine. It will be appreciated that since the shield 44 terminates at the upstream end of the low pressure turbine 18, the casing 20 portion which surrounds the low pressure turbine 18 is convection cooled by cooling air derived both from the cowling apertures 37 and the cooling air feed pipes 35.

Figure 4:
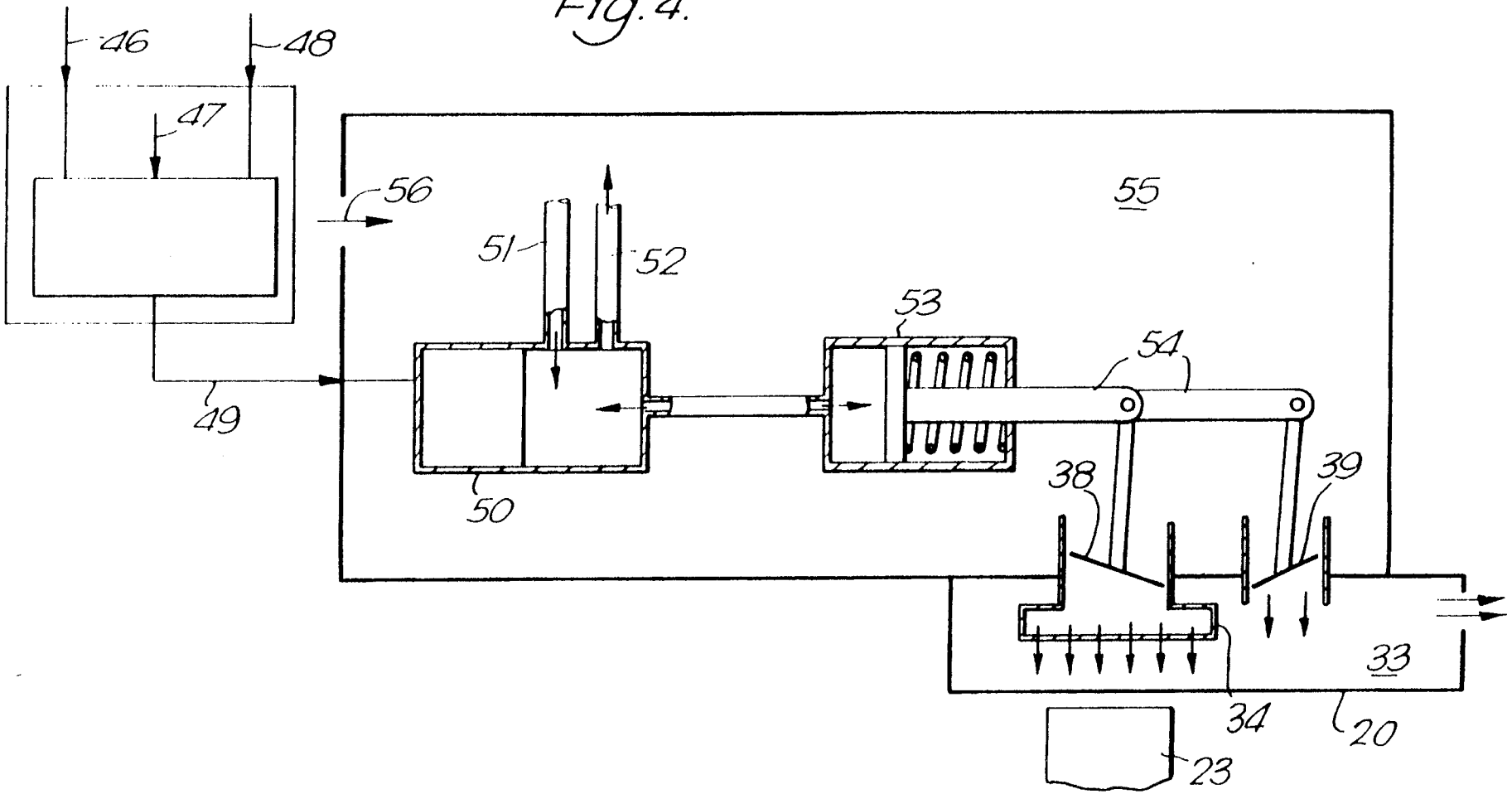
FIG. 4 is a schematic diagram of the casing cooling system of the turbine shown in FIGS. 2 and 3.

The manner in which the flap valves 38 and 39 are controlled will now be described with reference to FIG. 4.

A control logic 45 receives input signals 46,47 and 48 from the engine throttle, a clock and an altimeter respectively. The control logic 45 provides an output signal 49 based upon these inputs which is directed to a solenoid valve 50. The solenoid valve 50 is supplied with high pressure air through an inlet 51 from the high pressure compressor 13. That air, depending upon the state of the solenoid valve 50, is either vented through the pipe 52 or is directed to a pneumatic actuator 53. Mechanical linkages 54 interconnect the actuator 53 with the flap valves 38 and 39.

The flap valves 38 and 39 constitute the exhaust outlets for cooling air directed into the zone 55 through the inlet from the engine fan 11.

The control logic 45 controls the flap valves 38 and 39 in such a manner that they are always in one of two states. In the first state, the flap valves 38 controlling the cooling air flow to the manifold 34 are half closed and the flap valves 37 in the cowling 32 are fully open. In the second state, the flap valves 38 are fully open and the flap valves 39 are fully closed.

When an aircraft powered by the engine 10 takes off i.e. when the engine throttle is moved to its full power position, the signal 46 from the throttle causes the logic control 45 to provide an output signal 49 which results in the flap valves 38 and 39 moving to the previously mentioned first state. Thus cooling air is directed through the flap valves 38 at approximately half its maximum possible rate and cooling is directed through the flap valves 39 at maximum rate. Under these conditions, the cooling air exhausted from the manifold 34 provides both impingement cooling and convection cooling of the upstream portion of the turbine casing 20. The downstream portion of the turbine casing 20 is convection cooled both by air from the flap valves 39 and from air originating from the manifold 34 which has been exhausted from the shield 44. It will be seen therefore that cooling air originating from the flap valves 38 and 39 provides generalised cooling of the turbine casing 20. Such cooling ensures that under full power conditions, the casing 20 does not reach temperatures which are so high that the use of expensive high temperature resistant alloys are necessary for its construction. Nevertheless it is permitted to rise to a temperature which is sufficiently high to ensure that the casing 20 thermally expands enough to avoid the centrifugally loaded and thermally expanding turbine rotor blades 23,25,26 and 27 coming into damaging contact with the sealing members 31.

It will be appreciated that under full power conditions, the temperatures within the turbine 18 will rise rapidly resulting in the rapid thermal expansion of the turbine rotor blades 23,25,26 and 27. Moreover the high centrifugal loadings on those turbine blades under full power conditions result in the additional radial growth of those blades. Additionally the rapid gas temperature increase would also result in the casing 20 thermally expanding at a very high rate were it not for The passage of cooling air through the annular space 33. Thus the flow of cooling air is arranged to be at such a rate that the rates of radial expansion of the casing 20 and The turbine rotor blades 23,25,26 and 27 are substantially matched so as to maintain an acceptable rotor blade/sealing member 31 radial clearance.

When full power engine operation is no longer required and the engine 10 is throttled back to cruise conditions, the temperatures within the turbine 18 fall correspondingly. This results in the radial shrinkage of both the turbine rotor blades 23,25,26 and 27 and the turbine casing 20. However the turbine blade shrinkage is greater than that of the turbine casing 20, particularly in the case of the region of the intermediate pressure turbine 17. This consequently results in the radial gap between the turbine rotor blades 23 and their associated sealing member 31 being greater than would otherwise be desirable from the point of view of turbine efficiency.

In order to avoid the situation of an excessive radial gap between the turbine rotor blades 23 and its associated sealing member 31, the control logic, triggered by the throttle angle, time and altitude input signals 46,47 and 48, switches the flap valves 38 and 39 to the previously mentioned second stage. This results in the flap valves 39 closing and the flap valves 38 fully opening. Consequently a greater flow of cooling air is directed into the manifold 34 to provide exhausted impingement cooling of the turbine casing 20 portion in the intermediate pressure turbine 17. As a result, that portion of the casing 20 thermally contracts to reduce the radial gap between the turbine rotor blades 23 and their associated sealing member 31; turbine efficiency is thereby enhanced.

After providing impingement cooling of the casing 20, the cooling air then flows, as previously described, in both upstream and downstream directions to provide convective cooling of the remainder of the casing 20. Such convective cooling is sufficient to ensure that the casing 20 is cooled to such an extent that the remaining turbine blade/sealing member clearances are maintained at acceptable values.

It will be seen that the use of throttle angle To dictate the distribution of cooling air directed on to the casing ensures that the cooling of the casing is altered as soon as possible when changes in thermal conditions within the turbine take place. Thus casing cooling effectively changes in anticipation of changes in casing thermal conditions.

It will also be seen that the present invention, as well as permitting the use of a cheaper, lower temperature resistant alloy than would otherwise be the case, additionally ensures a fast response rate for the expansion and contraction of the casing 20. This is because the casing 20 is thin, and therefore does not require slugging masses or thermal barriers with their associated slow thermal response rates.

Although the present invention has been described with reference to a turbine in which external parameters i.e. throttle angle and altitude, have been chosen to control the operation of the flap valves 38 and 39, it will be appreciated that the parameters could be utilised. Thus for instance, internal parameters such as engine compressor speed or appropriate turbine temperatures could be utilised.

We claim:

1. A gas turbine engine turbine comprising a casing enclosing a plurality of annular arrays of rotor aerofoil blades, said blades being arranged in radially spaced apart relationship with said casing, means being provided to direct cooling air onto the outer surface of said casing to provide cooling thereof, control means being provided to control the distribution of cooling air so directed onto said casing between two circumferential axially adjacent regions of said casing, one of said region being axially forward and the other rearward of said forward region, means being provided to facilitate a flow of cooling air from the forward of said regions to the rearward of said regions, said control means being adapted to vary the distribution of said cooling air between a first condition in which all of said cooling air is initially directed onto the forward region of said casing and a second condition in which some of said cooling air is initially directed onto the forward regions of said casing and the remainder is directed only onto the rearward region of said casing, a manifold being located externally of the forward region of said casing, said manifold being adapted to be supplied with cooling air and to direct that cooling air onto said forward region of said casing to provide at least impingement cooling thereof, said casing having walls positioned so that at least some of the cooling air directed onto said forward region of said casing to cause impingement cooling thereof is subsequently caused to flow over the rearward region of said casing to provide convection cooling thereof, pipe members being provided to divide the cooling air directed onto said forward region of said casing into two portions with one portion subsequently caused to flow over said forward region in a generally upstream direction and the other portion in a generally downstream direction to provide convection cooling thereof.

2. A gas turbine engine turbine as claimed in claim 1 characterised in that said means provided to facilitate a flow of cooling air from said forward to said rearward regions comprises a cowling member (44) provided externally of said turbine casing (20) in spaced apart relationship therewith, said cooling air flowing through the space defined between said cowling member (44) and said turbine casing (20).

3. A gas turbine engine turbine as claimed in claim 1 characterised in that said control means (38,39) is adapted to operate in accordance with an operational command signal to said engine.

4. A gas turbine engine turbine as claimed in claim 3 characterised in that means are provided to generate said operational command signal in accordance with the angle of the throttle of said engine.

5. A gas turbine engine turbine as claimed in claim 1 characterised in that said rotor aerofoil blades (23) constitute part of the intermediate pressure portion of said turbine (18).

6. A gas turbine engine turbine as claimed in claim 1 characterised in that sealing members (31) are interposed between said casing and said annular arrays of rotor aerofoil blades (23).

7. A gas turbine engine turbine as claimed in claim 1 characterised in that said control means includes valves (38,39) which are adapted to control the distribution of cooling air flow on to said turbine casing (20) outer surface.

8. A gas turbine engine turbine comprising a casing enclosing a plurality of annular arrays of rotor aerofoil blades, said blades being arranged in radially spaced apart relationship with said casing, means being provided to direct cooling air onto the outer surface of said casing to provide cooling thereof, control means being provided to control the distribution of cooling air so directed onto said casing between two circumferential axially adjacent regions of said casing, one of said regions being axially forward and the other rearward of said forward region, means being provided to facilitate a flow of cooling air from the forward of said regions to the rearward of said regions, said control means being adapted to vary the distribution of said cooling air between a first condition in which all of said cooling air is initially directed onto the forward region of said casing and a second condition in which some of said cooling air is initially directed onto the forward regions of said casing and the remainder is directed only onto the rearward region of said casing, said control means being adapted to operate in accordance with an operational command signal to said engine, said control means being additionally adapted to operate in accordance with a signal representative of the altitude of said gas turbine engine.

* * * * *